United States Patent [19]

Cristy

[11] 4,074,474

[45] Feb. 21, 1978

[54] FLOOR SUPPORT ARRANGEMENT

[76] Inventor: Nicholas G. Cristy, 9 S. View Ave., Pleasantville, N.Y. 10570

[21] Appl. No.: 620,767

[22] Filed: Oct. 8, 1975

[51] Int. Cl.[2] ..... E04D 15/00

[52] U.S. Cl. ..... 52/2; 52/126; 248/400

[58] Field of Search ..... 52/126, 480, 2; 248/350, 22, 400; 108/136, 144

[56] References Cited

U.S. PATENT DOCUMENTS

| | | | |
|---|---|---|---|
| 2,743,487 | 5/1956 | Kuhlman | 52/480 X |
| 3,351,027 | 11/1967 | Ellard, Jr. et al. | 248/350 UX |
| 3,721,096 | 3/1973 | Deckert, Jr. et al. | 248/350 X |

*Primary Examiner*—Price C. Faw, Jr.

*Assistant Examiner*—Carl D. Friedman

*Attorney, Agent, or Firm*—Frank J. Thompson

[57] ABSTRACT

An improved resilient support for a floor is described. A rigid support means is positioned between a base platform surface and the floor for rigidly supporting the floor above the base surface. A pneumatic support means is also positioned between the base platform surface and the floor for vertically displacing and resiliently supporting the floor above the rigid support. Control means cause the pneumatic support means to alternatively seat the floor on the rigid support means in order to provide a rigid support or to raise the floor above the rigid support in order to provide a resilient floor support. The control means is adapted for establishing a desired floor resiliency by varying operating pressure of the pneumatic support means.

18 Claims, 9 Drawing Figures

Fig. 2
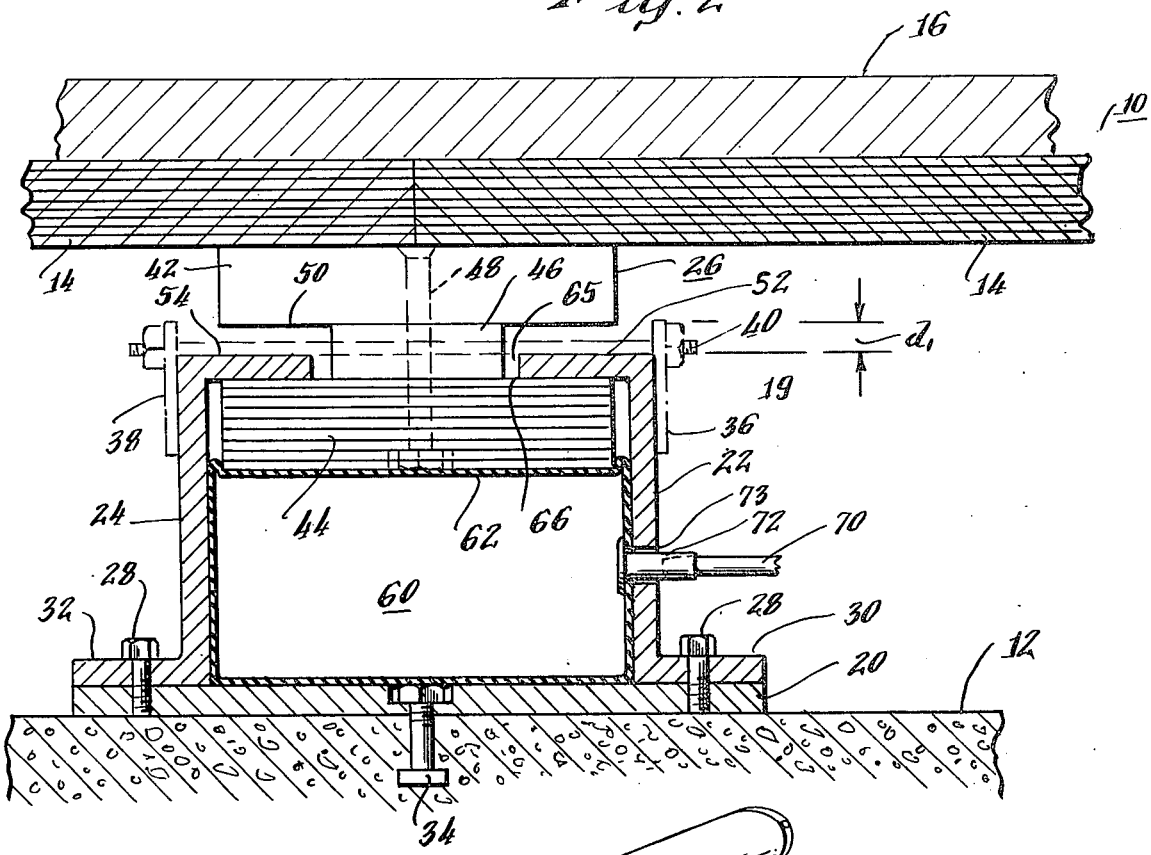
Fig. 3.
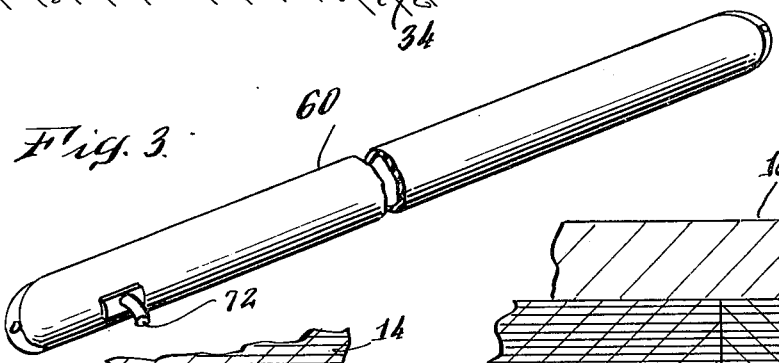
Fig. 7.
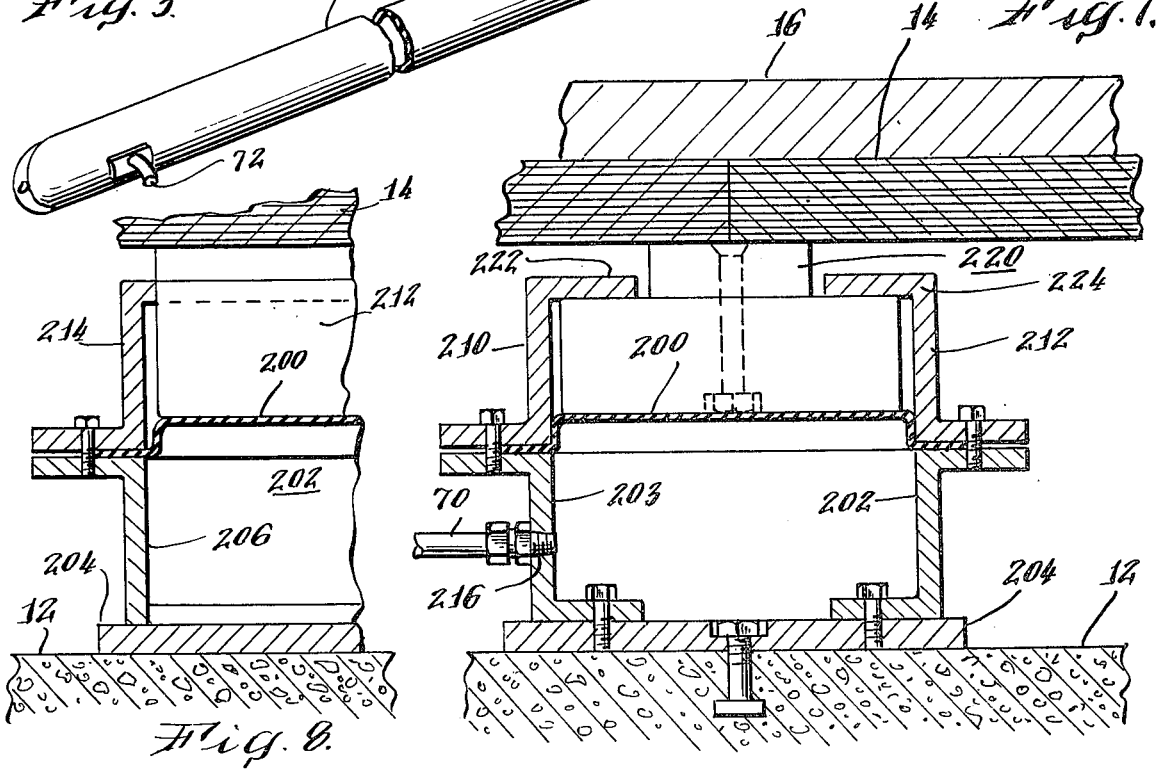
Fig. 8.

FLOOR SUPPORT ARRANGEMENT

BACKGROUND OF THE INVENTION

This invention relates generally to arrangements for supporting a floor. The invention relates more particularly to an improved arrangement for providing resilient support of a floor.

In various activities, the physical characteristics of a floor upon which an activity is carried out can be important. For example, theatrical dancing exhibitions such as ballet and tap dancing are best carried out on a relatively firm surface. At times, however, the activity may require a floor having conflicting characteristics. While in the theatre it is preferable that the dancing arts be carried out on a relatively firm surface as indicated in order to provide desired foot support, it is also desirable that the floor exhibit resilience under this live load in order to reduce the fatigue and possiblity of injury which accompanies prolonged dancing exhibitions. However, floors which are relatively firm or hard tend to exhibit little "give" or resiliency. Other forms of physical activity which are performed on firm floor surfaces are also accompanied by leg fatigue which can be reduced by rendering the firm floor more resilient. These other forms of activities include athletics such as basketball and calisthenics which are conducted on a gymnasium floor or equivalent surface as well as various economic and business activities including attending to the operation of machinery and the like. Furthermore, in some activities it may be desirable for the floor area to exhibit a variation in resiliency across its surface area. In theatrical stage productions, for example, relatively heavy props and scenery require a stage which provides a hard non-resilient support while the same stage preferably provides a firm yet resilient surface for dancing exhibitions.

Various techniques have been employed in order to reduce the fatigue and possibility of injury resulting from stiff floor surfaces. These prior techniques generally provide for underpadding or for a somewhat softer or cushioned surface through the use of composition floor surfaces. These techniques however have not fully provided for a floor which exhibits the desired contrasting characteristics of firmness and resilience necessary in many activities.

Accordingly, it is an object of this invention to provide an improved resilient floor support arrangement.

Another object of the invention is to provide an improved resilient floor support arrangement having means for adjustment the resilience of the floor.

Another object of the invention is to provide an improved floor support arrangement adapted for providing localized resiliencies across the area of a same floor in accordance with the activity which is to be engaged in at particular areas of the floor.

In accordance with the general features of this invention, an improved floor support arrangement comprises a base platform having a surface upon which the floor is to be supported. A rigid support means is positioned between the base platform surface and the floor for rigidly supporting the floor above the base surface. A pneumatic support means is positioned between the base platform surface and the floor and vertically displaces and resiliently supports the floor above the rigid support. A control means is provided for selectively causing the pneumatic support means to alternatively seat the floor on the rigid support means in order to provide a rigid support or to vertically displace the floor from the rigid support in order to provide a resilient floor support. The control means is adapted for establishing a desired floor resiliency by varying operating pressure of the pneumatic support means.

In accordance with more particular features of the invention, the pneumatic support means comprises an enclosure having a flexible wall member thereof. The control means is adapted to supply a gaseous fluid to the enclosure for establishing a pressure within the enclosure at the flexible wall thereby selectively providing a rigid or a resilient support for the floor. The enclosure is provided in accordance with one embodiment of the invention by elongated or toridally shaped bags such as are provided by automotive tire inner tubes and, in accordance with another embodiment of the invention by means including a flexible diaphragm member.

In accordance with still other features of the invention, the rigid support means and pneumatic support means are positioned with respect to the supported floor area and are independently controlled by the control means for establishing gradations in the resiliency of a floor across the area of the floor. Floor segments are also provided and rigid and pneumatic support means are arranged for independently supporting the floor segments whereby resiliency of the segments are independently controlled.

These and other objects and features of the invention will become apparent with reference to the following specifications and to the drawings wherein:

DESCRIPTION OF THE DRAWINGS

FIG. 2 is an enlarged section view taken along lines 2—2 of FIG. 1;

FIG. 3 is a perspective view of an elongated pneumatic bag utilized with the floor support arrangement of FIG. 2;

FIG. 7 is a fragmentary, elevation view in section of a pneumatic floor support means and rigid floor support means constructed in accordance with an alternative embodiment of the invention;

FIG. 8 is an elevation view in section of an end segment of the pneumatic and rigid floor support means of FIG. 7; and, FIG. 9 is a fragmentary elevation view in section of a pneumatic floor support means and rigid floor support means constructed in accordance with an alternative embodiment of the invention.

Referring now to FIGS. 1 and 2, a floor indicated generally as 10 is shown to be supported above a base platform surface 12 comprising a flat concrete floor or foundation. This base platform surface 12 can alternatively comprise the surface of wall extensions rising from a base. While various floor arrangements and surfaces can be provided to satisfy the particular need of the activity, the supported floor 10 is shown to comprise an assembly of plywood subfloor panels 14 upon which is secured a finished floor formed by interconnecting, tongue and groove floor strip members 16. The floor strip members 16 may be secured to the plywood panels by suitable means such as flooring nails.

Figure 1:
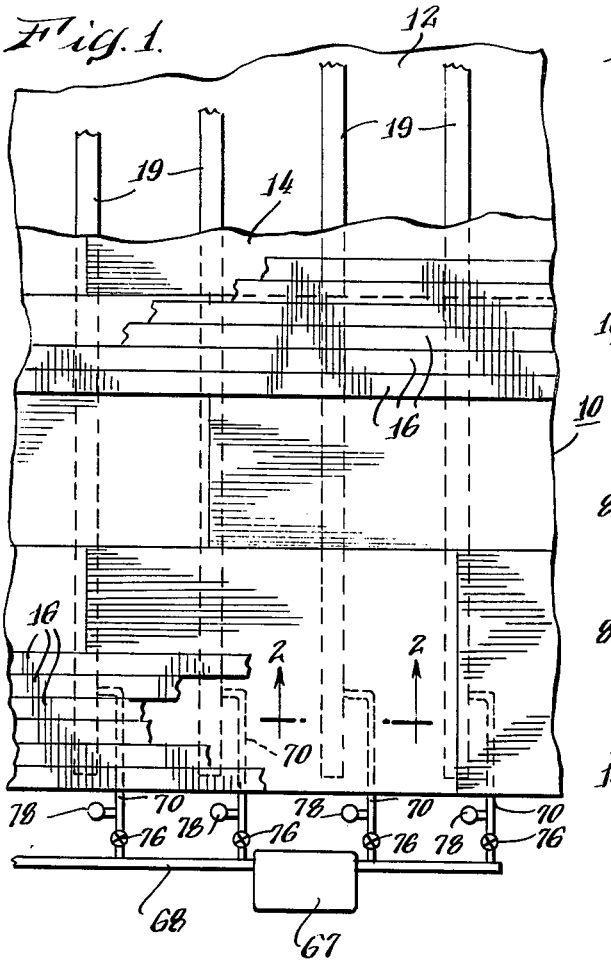
FIG. 1 is a fragmentary plan view, partially broken away, illustrating a floor and a floor support arrangement constructed in accordance with features of one embodiment of this invention.

A rigid support means is provided and is positioned between the floor 10 and the base platform surface 12 for rigidly supporting the floor 10. This rigid support means comprises, as illustrated in FIGS. 1 and 2, a plurality of parallel, elongated piers 19 which extend across the area of the floor 10 along one length of the floor 10. Spacing of the piers is provided at convenient distances such as 2 ft. on centers in order to satisfy municipal building code requirements respecting structural loading and to accommodate conventional sized materials such as 4 × 8 ft. subfloor panels 14. A pier 19, as illustrated in detail in FIG. 2, is shown to comprise a plate member 20, a pair of vertically extending Z shaped frame members 22 and 24, an intermediate support body referenced generally as 26, and a means for securing the plate and frame members in a rigid assembly. The latter means includes anchor bolts and nuts 28 spaced along the length of a pier and which extend through apertures in the plate 20 and in flange segments 30 and 32 of the frame member 22 and 24 respectively for securing the frame members to the plate 20. Plate 20 is secured to the base platform surface 12 by anchor bolts 34 spaced along the length of the plate. A pair of plates 36 and 38 are positioned along the length of the pier 19 and are secured in position about the frame members 22 and 24 by tie rods 40 located near each end of a pier. These rods and plates establish a tension force which secures the frame assembly under loading.

While the intermediate support body 26 may have various forms, it is shown formed as an assembly of a wood plate segment 42 and a plywood plate segment 44 which are spaced apart by a relatively narrow width segment 46. this assembly is secured together by bolts 48 or by other well known means such as screws, nails, gluing, etc. A lower surface 50 of the intermediate body member 42 seats on upper surfaces of flange segments 52 and 54 of the frame members 22 and 24 respectively. When thus seated, the floor 10 is rigidly supported on the base platform surface 12 by the pier 19.

A pneumatic support means is provided and is positioned between the base support surface 12 and the floor 10 for vertically displacing and resiliently supporting the floor 10 above the rigid support means. The pneumatic support means comprises, in general, an enclosure having a flexible wall member upon which the floor 10 is resiliently supported. In FIG. 2, the enclosure comprises an elongated inflatable bag 60 which is positioned between the frame members 22 and 24 and extends for the length of the pier 19. The bag 60, when inflated, conforms to the volume defined by the inner surfaces of the frame members 22 and 24 and contacts a lower surface 62 of the intermediate support body 26. As the bag 60 is inflated it raises the intermediate support body 26 and thus the floor 10 from its seated position on the rigid support means as is illustrated in FIG. 2. Intermediate support body 26 is raised from the pier 19 through a vertical distance $d_1$ as shown in FIG. 2. This vertical distance $d_1$ is determined by the thickness of the segment 46 and by the thickness of the flanges 52 and 54. The dimensions of the intermediate body 26 are selected to provide for vertical travel of the narrow segment 46 through an aperture or slot 65 formed between flanges 52 and 54. As the inner surfaces of these flanges contact an upper surface 66 of the segment 44, further upward vertical travel is restricted.

A control means for selectively causing the pneumatic support means to seat the floor 10 on the rigid support means or alternatively to vertically displace the floor from the rigid support means is provided. The control means, illustrated in FIG. 1, comprises a source 67 of a pressurized gas such as air, a gas supply manifold 68, conduits 70 which couple the gas under pressure from the manifold 68 to the enclosures of the piers 19, and a valving arrangement. As illustrated in FIG. 2, the air bag 60 includes a flexible stem or tube 72 which extends through an aperture 73 in the frame member 22, about the conduit 70 and forms a gas tight seal with conduit 70. An exemplary valving arrangement comprises a manually or remotely adjustable, pressure indicating differential-pressure operated flow valve 76 which is coupled in the gas flow path of each conduit 70 along with a bleeder line and valve 78. The valve 76 is adapted to be set to a predetermined pressure $P_L$ representing the desired internal pressure $P_B$ of the bag 60. When a differential pressure exists i.e., $\Delta P = P_L - P_B$, then the valve 76 permits gas flow until $P_L = P_B$. One such valve is that found in automobile service stations which are manually set for filling automobile and truck tires. The bleeder valve 78 is operated for reducing pressure within the bag 60. It may be operated remotely through the use of a solenoid actuation or it can be operated manually.

When the valves 76 are adjusted to create a differential pressure $\Delta P$, the air bags 60 inflate. The floor 10 will remain seated on the piers 19 or alternatively will be raised from the piers and will be resiliently supported by this pneumatic support means, depending upon the pressure $P_L$ established at the valve 76 and thus in the bag $P_B$. While the hardness of the floor 10 is determined by the composition of the floor surface, the resilience or "give" of the floor 10 will be determined by the air bag pressure $P_B$. As the pressure $P_B$ is increased, the supportive force provided by the bag becomes greater and the support is relatively firmer than at lower values of pressure $P_B$. Conversely, as the pressure $P_B$ is reduced the supportive force becomes less and the resilience is increased. Upon inflation of the air bags to a minimum pressure $P_M$, the floor 10 will be displaced vertically by the distance $d_1$ (FIG. 2). Floor resilience at this pressure represents maximumm resilience or "give" for the resiliently supported floor. As the pressure $P_B$ is increased above $P_M$, the resilience or "give" of the resiliently supported floor decreases.

The pneumatic support bag 60 can be fabricated of various materials including, reinforced rubber, a vinyl coated fabric or other similar flexible, durable material which is air tight and which preferably does not stretch under operative pressures. While the bag is preferably rectangular shaped to assume a generally rectangular cross section as illustrated in FIG. 2, the bag may also have other cross-section configurations. As illustrated in FIG. 3, the bag includes grommets formed in seam members at opposite ends thereof which enable a deflated bag to be drawn through the elongated pier 19 for installation or removal.

In operation, a uniform resiliency is provided for the supported floor 10 by adjusting the valves 76 to the same desired pressure. Alternatively, the provision of separate conduits 70, valves 76 and bleeder valves 78 enables the establishment of different pressures in the air bags of the piers 19. Thus, as shown in FIG. 1, a graduated floor resiliency can be provided in a direction normal to the longitudinal dimension of the piers 19 by establishing graduated pressures in the air bags of these piers.

Figure 4:
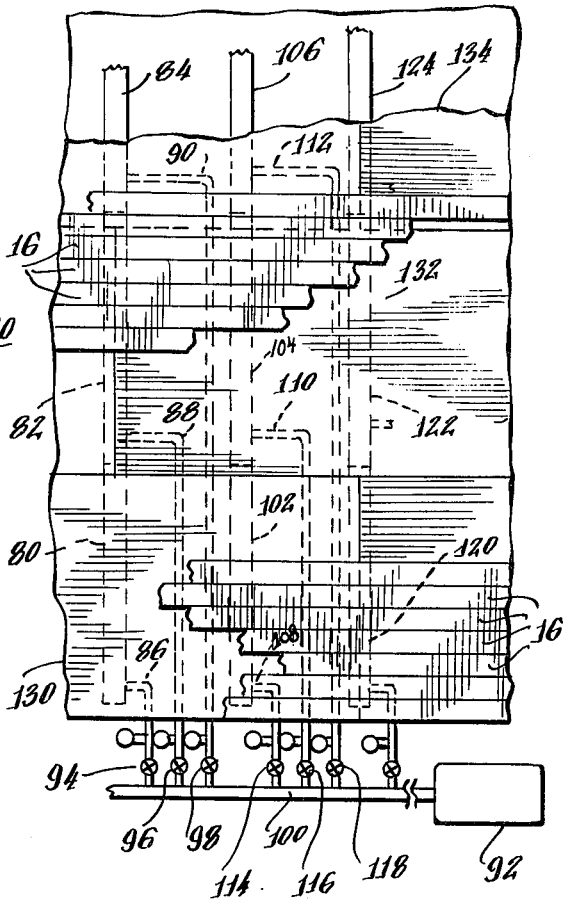
FIG. 4 is a fragmentary plan view, partially broken away, illustrating a floor support arrangement constructed in accordance with an alternative embodiment of the invention.

Floor resiliency graduations along two dimensions of the floor can be provided by the floor support arrangement of FIG. 4. FIG. 4 illustrates an alternative embodiment of the floor support arrangement of this invention. A plurality of piers 80, 82 and 84 are provided and are longitudinally aligned in the direction of one length of the floor. Separate gas supply conduits 86, 88 and 90 couple the air bags of each of the piers to the gas supply 92 via differential pressure flow valves 94, 96, and 98 and a manifold 100. Similarly, air bags of piers 102, 104 and 106 supplied through conduit 108, 110, and 112 respectively via differential pressure flow valves 114, 116 and 118 and the manifold 100. A similar arrangement is provided for piers 120, 122 and 124 and other floor support piers. This floor support arrangement is advantageous in that pressure graduations can be established along mutually perpendicular dimensions of the floor 10. In addition, individual floor segments 130, 132 and 134 can be independently supported with different resiliencies. For example, the floor segment 130 may constitute a forward portion of a stage where dancing activities are to be conducted. The pressures of penumatic support means associated with piers 80, 102 and 120 can be adjusted to provide a resilient support. On the other hand, the floor segment 134 may be required to support relatively heavy stage props and the pneumatic support means can seat this floor segment on piers 84, 106 and 124 to provide a firm, rigid support.

Figure 5:
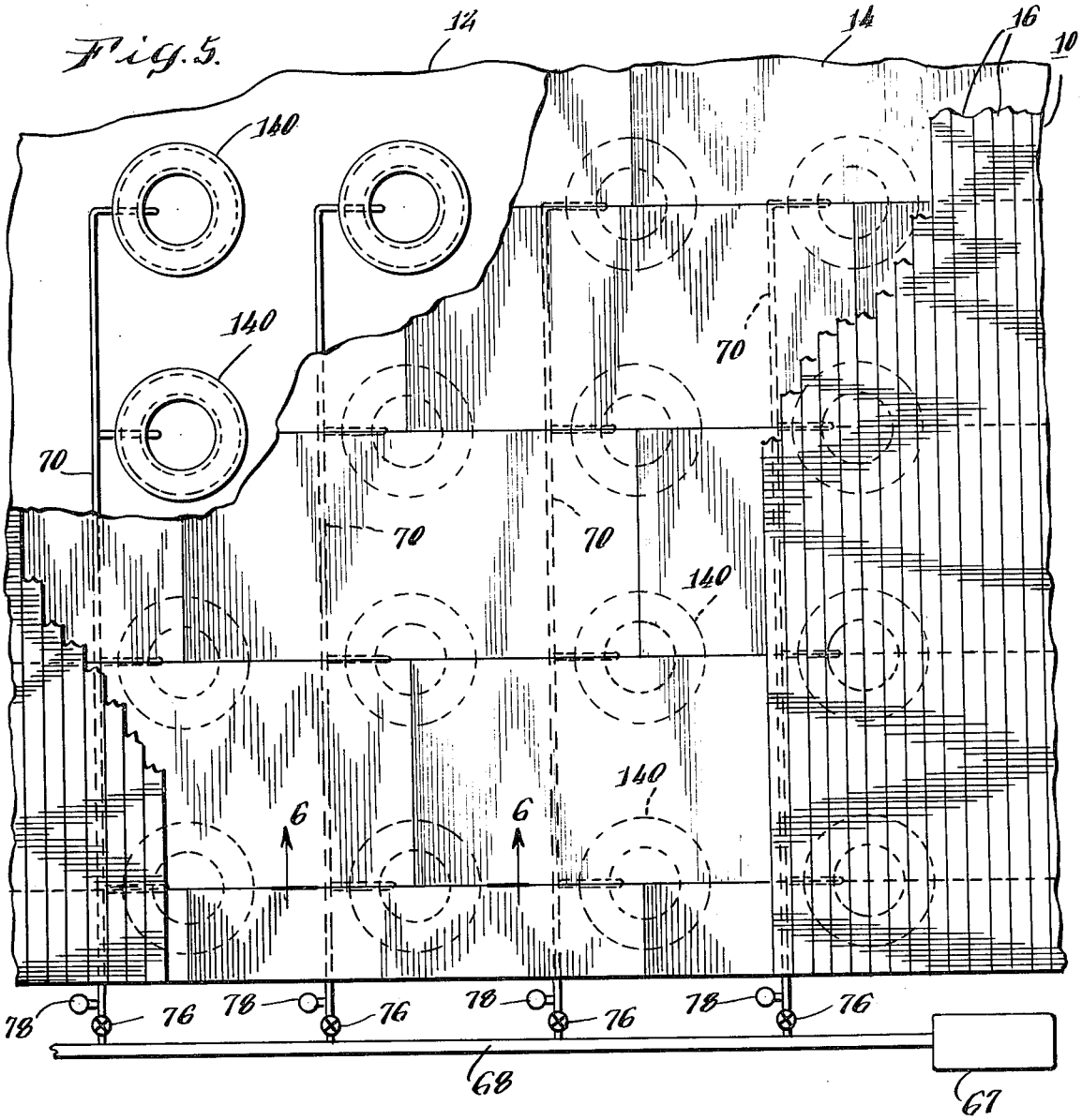
FIG. 5 is a fragmentary plan view, partially broken away, illustrating a floor support arrangement constructed in accordance with an alternative embodiment of the present invention.
Figure 6:
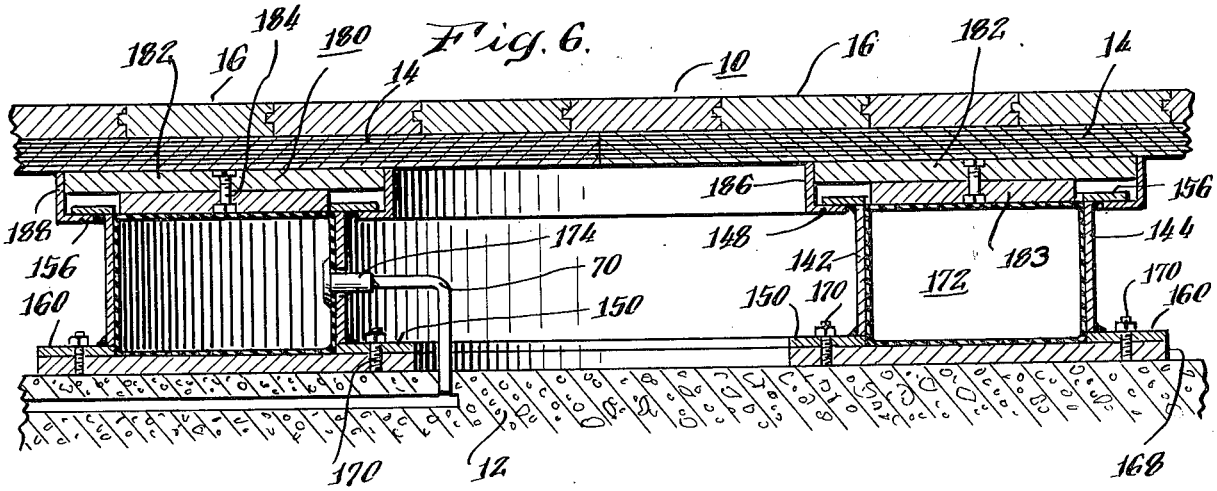
FIG. 6 is an enlarged section view taken along lines 6—6 of FIG. 5.

A resilient floor support means arranged as a plurality of spaced apart pillars and associated toroidally shaped pneumatic support means is illustrated in FIGS. 5 and 6. Those elements of FIG. 5 which perform functions similar to elements of FIG. 1 bear the same reference numerals. A plurality of pillars 140 are provided and are aligned as illustrated in FIG. 5 for supporting the floor 10 over its surface area. A pillar 140, as illustrated in FIG. 6, includes inner and outer cylinders 142 and 144 respectively. A circular plate 148 is welded to an upper edge of the inner cylinder 142 and a circular plate 150 is welded to a lower edge thereof. Similarly, a circular plate 156 is welded to an upper edge of the outer cylinder 144 and a circular plate 160 is welded to a lower edge thereof. This assembly is secured to a circular plate 168 by bolts and nuts 170 which extend through the plate 168 and engage the plates 150 and 160.

A pneumatic support means employed with the arrangement of FIG. 6 comprises a toroidally shaped bag 172 which is positioned between the cylindrical bodies 142 and 144. The bag 172 is fabricated of the same materials as was described with respect to the bag of FIGS. 2 and 3. A valve stem 174 engages the conduit 70 for conveying a gaseous fluid to the bag as was described with respect to the floor support arrangement of FIG. 1. When automotive inner tubes are employed as pneumatic supports, the stem 174 may extend toward the center of the toroid in which case the conduit 70 will extend through the base 12 to the center area of the toroid.

A circular shaped intermediate support body 180 is provided and comprises a pair of wood rings 182 and 183 which are secured together by bolting or gluing. A lower surface of the ring 182 is positioned against an upper surface or wall of the bag 172, and, as the bag is inflated as illustated in FIG. 6, intermediate support body ring 182 is raised off the plates 148 and 156. The floor 10 is raised thereby providing a resilient support for the floor. Angle plates 186 and 188 are secured to inner and outer edges of intermediate support segment 182. These angles limit vertical travel as they contact lower surfaces of the plates 148 and 156. The pillar arrangement of FIG. 5 can be modified to provide individual air supply lines to each of the piers and associated bags and thus provide graduated floor resilience in two dimensions as was described with respect to FIG. 4.

In another embodiment of the invention as illustrated in FIG. 7, the pneumatic support means enclosure is provided by a flexible diaphragm wall member 200 and by rigid surface members comprising a pair of lower frame members 202 and 203, a plate 204, and an end plate 206 which, as illustrated in FIG. 8, is formed integrally with the lower frame members 202 and 203. The flexible diaphragm 200 which is formed of rubber or vinyl coated fabric or other similar durable material is secured in position by flange segments of upper frame members 210, 212 (FIG. 7) and 214 (FIG. 8). A segment of the wall member 203 is threaded to receive a fitting 216 which communicates with the conduit 70 for conveying a gas to the enclosed volume for causing vertical deflection of the diaphragm 200. An intermediate support body 220 is positioned on the flexible diaphragm surface 200 and when the enclosed volume is pressurized as illustrated in FIG. 7, the intermediate body is raised vertically until it is stopped by flange segments 222 and 224 of the frame members 210 and 212 respectively. Control of pressurization of the enclosed volume for raising and lowering the diaphragm 200 and thus the floor 10 is accomplished in the same manner as was described hereinbefore with respect to FIG. 1.

Figure 9:
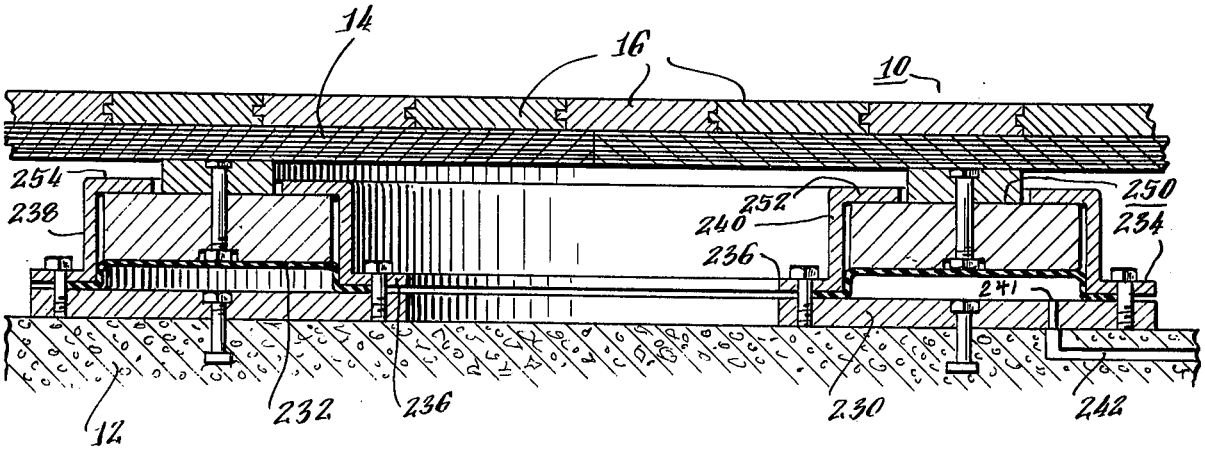

Another embodiment of the invention wherein the pneumatic support means; includes a diaphragm and has a relatively low profile is illustrated in FIG. 9. In this arrangement, the enclosure of the pneumatic support means is toroidal shaped and is provided by a circular plate 230 and a circular diaphragm 232. Gas tight sealing is provided at a periphery of the diaphragm 232 where it is secured between the plate 230 and flanges 234 and 236 of frame members 238 and 240 respectively. A bore 241 is formed in the plate 230 and communicates between this enclosure and a channel 242 to which gas from a source is applied via a conduit, valving means and mainfold as described hereinbefore. An intermediate support means 250 is provided and is positioned partly within the frame on the surface of the diaphragm 232. When the enclosure is pressurized as is illustrated in FIG. 9, the intermediate support means 250 is raised and the subfloor 14 is vertically displaced from the surface of upper flange segments 252 and 254 of the frame members 236 and 238 respectively.

There has thus been described an improved form of resilient floor support which advantageously provides for varying the resiliency of a supported floor and for alternatively rigidly supporting the floor. The resiliency may be graduated across the surface area of the floor in one or two directions and the resilience of individual segments of the floor can be varied.

While I have described various embodiments of my invention, it will be apparent to those skilled in the art that variations may be made thereto without departing from the spirit of the invention or the scope of the appended claims.

What is claimed is:

1. An improved floor support arrangement for theatrical, dancing and athletic activities comprising:

A. a base platform having a surface thereof;

B. a floor;

C. rigid support means positioned between said base platform surface and said floor for rigidly supporting said floor above said base surface;

D. an inflatable pneumatic support means positioned between said base platform surface and said floor for vertically displacing and resiliently supporting said floor above said rigid support means, said pneumatic support means substantially enclosed by said rigid support means;

E. said rigid support means adapted for receiving and supporting a floor load transferred thereto from said inflated pneumatic support means; and F. control means for selectively causing said pneumatic support means to seat said floor on said rigid support means for transferring said floor load from said pneumatic support means to said rigid support means or to displace said floor from said rigid support means to said pneumatic support means whereby said floor is alternatively rigidly or resiliently supported.

2. The floor support arrangement of claim 1 wherein said pneumatic support means comprises an enclosure having a flexible wall and said control means is adapted to supply a gaseous fluid to said enclosure for establishing a pressure in said enclosure at said flexible wall and for varying the pressure within said enclosure for selectively altering the resiliency of said supported floor.

3. The floor support arrangement of claim 2 wherein said rigid support means comprises a plurality of spaced apart elongated piers.

4. The floor support arrangement of claim 2 wherein said rigid support means comprises a plurality of spaced apart pillars.

5. The floor support arrangement of claim 2 wherein said pneumatic support means comprises an inflatable, flexible walled body.

6. The floor support arrangement of claim 5 wherein said inflatable body comprises an elongated bag.

7. The floor support arrangement of claim 5 wherein said inflatable body comprises a toroidally shaped bag.

8. The floor support arrangement of claim 2 wherein said enclosure includes at least one flexible, diaphragm surface member for supporting said floor.

9. An improved floor support arrangement comprising:

A. a base platform having a surface thereof;

B. a floor;

C. rigid support means positioned between said base platform surface and said floor for rigidly supporting said floor above said base surface;

D. pneumatic support means positioned between said base platform surface and said floor for vertically displacing and resiliently supporting said floor above said rigid support means;

E. control means for selectively causing said pneumatic support means to seat said floor on said rigid support means or to displace said floor from said rigid support means whereby said floor is alternatively rigidly or resiliently supported;

F. said pneumatic support means comprising an enclosure having a flexible wall and said control means is adapted to supply a gaseous fluid to said enclosure for establishing a pressure in said enclosure at said flexible wall for varying the pressure within said enclosure for selectively altering the resiliency of said supported floor;

G. said enclosure including at least one flexible, diaphragm surface member for supporting said floor; and H. said flexible diaphragm surface member comprises a horizontally extending sheet of flexible material which extends in a vertical direction when said enclosure is pressurized and means for providing a gas tight seal between said diaphragm and members of said enclosure.

10. The floor support arrangement of claim 9 wherein said wall members define an elongated volume.

11. The floor support arrangement of claim 9 wherein said wall members define a toroidally shaped enclosed volume.

12. The floor support arrangement of claim 2 wherein said rigid support means defines an elongated frame and said enclosure is positioned within said frame.

13. An improved floor support arrangement comprising:

A. a base platform having a surface thereof;

B. a floor;

C. a rigid support means positioned between said base platform surface and said floor for rigidly supporting said floor above said base surface;

D. pneumatic support means positioned between said base platform surface and said floor for vertically displacing and resiliently supporting said floor above said rigid support means;

E. control means for selectively causing said pneumatic support means to seat said floor on said rigid support means or to displace said floor from said rigid support means whereby said floor is alternatively rigidly or resiliently supported;

F. said pneumatic support means comprising an enclosure having a flexible wall and said control means is adapted to supply a gaseous fluid to said enclosure for establishing a pressure in said enclosure at said flexible wall for varying the pressure within said enclosure for selectively altering the resiliency of said supported floor;

G. said rigid support means defining an elongated frame and said enclosure is positioned within said frame; and, H. said frame including an apertured upper surface thereof and an intermediate support body is provided and is positioned on said flexible wall and extends through said apertured surface for supporting said floor.

14. The floor support arrangement of claim 13 wherein said floor comprises a composite floor having a subfloor and a live load bearing surface positioned on said subfloor and said floor assembly is supported on said intermediate support member.

15. The floor support arrangement of claim 1 including a plurality of rigid support means and a plurality of pneumatic support means associated with each of said rigid support means and wherein said control means is adapted for independently varying the pressure of at least two of said pneumatic support means.

16. The floor support arrangement of claim 15 wherein said pneumatic support means comprises a plurality of elongated inflatable bags.

17. The floor support arrangement of claim 16 wherein said pneumatic support means comprises a plurality of toroidally shaped inflatable bags.

18. An improved floor arrangement comprising:

A. a base platform having a surface thereof;

B. a floor;

C. rigid support means positioned between said base platform surface and said floor for rigidly supporting said floor above said base surface;

D. pneumatic support means positioned between said base platform surface and said floor for vertically displacing and resiliently supporting said floor above said rigid support means;

displacing and resiliently supporting said floor above said rigid support means;

E. control means for selectively causing said pneumatic support means to seat said floor on said rigid support means or to displace said floor from said rigid support means whereby said floor is alternatively rigidly or resiliently supported; F. said floor comprising a composite floor formed of independent segment areas; and, G. said rigid support and pneumatic support means are positioned for selectively varying the resilience of said floor segments.

* * * * *

UNITED STATES PATENT AND TRADEMARK OFFICE

CERTIFICATE OF CORRECTION

PATENT NO. : 4,074,474

DATED : Feb. 21, 1978

INVENTOR(S) : Nicholas G. Cristy

It is certified that error appears in the above-identified patent and that said Letters Patent are hereby corrected as shown below:

At column 9, line 11 and column 10, line 1

Delete "displacing and resiliently supporting said floor above said rigid support means;"

Signed and Sealed this

*Seventh* Day of *November 1978*

[SEAL]

*Attest:*

RUTH C. MASON
*Attesting Officer*

DONALD W. BANNER
*Commissioner of Patents and Trademarks*